US009308436B1

(12) United States Patent
Hays

(10) Patent No.: US 9,308,436 B1
(45) Date of Patent: Apr. 12, 2016

(54) CARD GAME AND METHOD FOR PLAYING

(71) Applicant: James Roy Hays, Tyler, TX (US)

(72) Inventor: James Roy Hays, Tyler, TX (US)

( * ) Notice: Subject to any disclaimer, the term of this patent is extended or adjusted under 35 U.S.C. 154(b) by 0 days.

(21) Appl. No.: 14/466,991

(22) Filed: Aug. 23, 2014

(51) Int. Cl.
*A63F 1/00* (2006.01)

(52) U.S. Cl.
CPC ..... *A63F 1/00* (2013.01); *A63F 2001/006* (2013.01)

(58) Field of Classification Search
CPC ..... A63F 2001/006
USPC ..... 273/292, 299, 308
See application file for complete search history.

(56) References Cited

U.S. PATENT DOCUMENTS 5,314,193 A * 5/1994 Ferrer ..... 273/292
5,368,305 A * 11/1994 Rodda et al. ..... 273/292
6,003,870 A * 12/1999 Johnson ..... A63F 1/02 273/292
6,651,984 B1 * 11/2003 Luken ..... A63F 1/00 273/292
6,905,122 B2 * 6/2005 Weigl et al. ..... 273/292
8,678,392 B1 * 3/2014 Alhazza ..... A63F 1/04 273/292
2001/0042960 A1 * 11/2001 Lewis et al. ..... 273/274
2005/0035551 A1 * 2/2005 Weigl ..... A63F 1/00 273/292
2005/0212213 A1 * 9/2005 Inglese ..... 273/292
2006/0284379 A1 * 12/2006 Weigl ..... A63F 1/00 273/292
2007/0158907 A1 * 7/2007 Weigl ..... A63F 1/00 273/292

* cited by examiner

*Primary Examiner* — Benjamin Layno

(57) ABSTRACT

A card game for 2-7 players. The game consists of seven (7) "Rounds." At the end of seven (7) "Rounds" the player with the lowest score wins. A "Round" is complete when a player sheds all cards from a "Hand." A "Hand" is a card set dealt by the Dealer to each player at the beginning of each "Round." Every player starts with a "Hand" consisting of seven (7) or fourteen (14) cards, dealt face down. The object of the game is to shed cards from your "Hand" by making "Books." "Books" may contain two cards adding to seven (7) or four or more cards adding to a number that is a multiple of seven (7), such as 7, 14, 21, 28, 35, 42, 49, etc. Once the original "Hand" is dealt, the "Round" begins by dealing one card from the Dealer Deck, face up, to the first player on the dealers left.

16 Claims, 2 Drawing Sheets

Section 2 – Process Flow

CARD GAME AND METHOD FOR PLAYING

FIELD OF INVENTION

This invention relates to a card game played with a uniquely designed deck of cards.

BACKGROUND OF THE INVENTION

Games facilitate fun, amusement, competition, and social interaction. The object of this invention, is to utilize the principle of prime numbers, mathematical probability along with some principles of card play, games, and amusements to deliver an exciting, challenging, amusing, and educational experience. In addition, this game provides a sense of community and social interaction with friends, families, and social venues. Many commercially available card games today, focus completely on chance and participate in passive socialization. In addition to the exciting element of luck and chance, this game adds the elements of mathematics, probability, suspense, challenge, and offensive strategy to the sense of community and active socialization.

Object of Game and how to Win

The object of the card game is, to shed cards from your "Hand" by making "Books" totaling seven (7) or multiples of seven (7). A game consists of seven (7) "Rounds." A "Round" is complete when a player no longer has cards remaining in their "Hand." The winner is the player with the lowest score when seven (7) "Rounds" are complete.

Scoring

1. When a player is dealt a "BONUS Card" face up from the Dealer's Deck, the player receives a minus 50 (−50) points immediately.
2. If a player sheds all of their cards in their first turn in a "Hand," the player receives a minus 100 (−100) points immediately.
3. When a player sheds all cards from their "Hand," the "Round" ends and that player receives "0" points. Players with cards remaining in their "Hand" receive a score based on the sum total using the following card values:
   Cards with the numerical value of 1, 2, 3, 4, 5, 6=5 points each
   BONUS Cards=20 point each
   PENALTY Cards, and SEVERE PENALTY Cards=10 points each
4. A player making a "Book" of four or more cards with a total numerical value adding to 63 points or more, will immediately receive a minus 50 (−50) points for creating that "Book."
5. The scores are tallied by the score keeper.

DETAIL DESCRIPTION OF THE INVENTION

The Dealer is chosen by cutting cards. Player with the highest numeric value card is the starting dealer. Dealer shuffles the 150 card deck and deals 7 or 14 cards to each player. Remaining cards are placed face down in front of the dealer creating the Dealer Deck. If the Dealer Deck is depleted before the "Round" is over, dealer collects and shuffles all played cards to create a new face down Dealer Deck.

The Dealer begins play by dealing the top card from the Dealer Deck to the player on the Dealer's left, face up for all players to observe:

1. If the dealt card is a "BONUS Card." the player immediately receives minus 50 (−50) points and may shed as many as three cards or as few as one card from "Hand" without using them in a book. Player does not pick up the "BONUS Card" and place it in his/her "Hand." Player may then continue to shed cards, making "Books" totaling seven (7) or multiples of seven (7), until the player can no longer continue shedding cards.
2. If the dealt card is a "PENALTY Card," the dealer deals three cards from Dealer Deck and the player places these three cards in their "Hand." Player does not add the "PENALTY Card" to their "Hand." The player may continue to shed cards until the player can no longer continue shedding cards.
3. If the dealt card is a "SEVERE PENALTY Card", the dealer deals three cards from Dealer Deck and the player places these three cards in his/her "Hand". Player does not add "SEVERE PENALTY Card" to their "Hand." The player may not continue to shed cards until the player's next turn.
4. If the dealt card is a "1, 2, 3, 4, 5 or 6", the player picks up the card and places it in his/her "Hand". Player may then continue play by shedding cards, until the player can no longer shed cards.

Playing Cards in Player's Hand and Making Books

1. If a player receives a PENALTY Card(s) as part of the 7 or 14 card deal, the player, during his/her turn, may shed these cards, face up, to any other player. The player receiving this card will not add the card to his/her "Hand." Instead, the dealer will deal three cards off the top of Dealer Deck and give, face down, to the player receiving the PENALTY Card(s). The player will add the three dealt cards to his/her "Hand." Multiple PENALTY Card(s) may be given to a single player. PENALTY Card(s) cannot be played in any "Book."
2. Player may play, face up, all "Books" of two (2) cards which add to seven (7): 6+1, 5+2, or 4+3.
3. Player may play "Books" of four or more cards which add to seven (7) or a number divisible by seven (7, 14, 21, 28 etc.) Example (1, 1, 1, 4); (4, 5, 4, 1). No two cards in the "Book" of four or more cards may add to seven. Example (6, 5, 2, 1) 6+1=7. 5+2=7.
4. To shed the BONUS Card received in the "Hand" of 7 or 14 cards, player must use the card in a "Book" of four or more cards which add to a number divisible by seven. Example (11, 6, 2, 2).
5. A player's turn ends when no more cards can be shed from "Hand."
6. The "Round" continues with the next player to the left.
7. When a player sheds all cards from his/her "Hand," the "Round" ends and that player gets "0" points.
8. All players with cards remaining in their "Hand" will count their points and tell the score keeper.
9. The scores will be recorded on the score card.
10. The Deal rotates one position to the left and the next "Round" begins.
11. The game ends after 7 complete "Rounds" are played.
12. The player with the lowest score, adding the pluses and minuses together, wins the game.

(See Section 2—FIG. 5—Process Flow)

Composition of the Card Deck

The deck contains 150 cards. The deck is made up of the following cards. There are: 20—1 s; 20—2 s; 20—3 s; 20—4 s; 20—5 s; 20—6 s; 10—Penalty Cards; 10—Severe Penalty Cards; 10—Bonus Cards.

Area of Play

This game is not limited to play in any specific area. It is a game that can be played worldwide. Rules are not subject to cultural or language differences. Rules are available in multiple languages.

Card Image Description

This card game is played with a specially designed deck of cards unique to this invention. The face and back of the cards utilized in this card game have numeric indicia and or design embodiments that match declarations in the rules for playing this card games.

Section 1 defines the images of the primary cards which make up the 150 card deck.

FIG. 1 is a drawing of the numeric indicia used for cards 1, 2, 3, 4, 5 and 6. The numeric indicia appears in the top left corner of the face of the card. There are twenty (20) cards for each numeric indicia.

FIG. 2 is a drawing depicting a card as a means of a player earning an immediate minus 50 (−50) point score if dealt to a player as a single face up card from the Dealer Deck. The card also has a value of 11 and may be used in "Books" of 4 or more cards. The numeric indicia appears in the top left corner of the face of the card. There are 10 cards with this depiction.

This invention is played utilizing standard bridge playing cards 3.5 inches by 2.25 inches and manufactured to a level of quality equal to cards utilized in casino gambling games. The face and back of the standard bridge playing cards utilized in this invention have numeric indicia and or design embodiments that match declarations in the rules for playing this invention. This invention can be played utilizing any other playing card size with numeric indicia and or design embodiments on the face or back of the cards or any other kind of playing card whether the dimensions and level of quality is less than or greater than those embodied by and specified for this invention.

Process Flow Description

Figure 1:
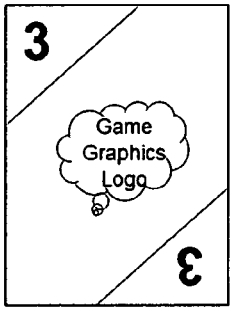
Figure 2:
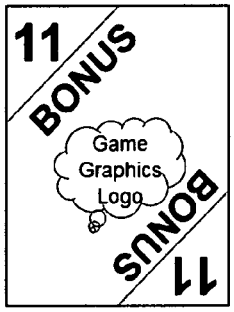
Figure 3:
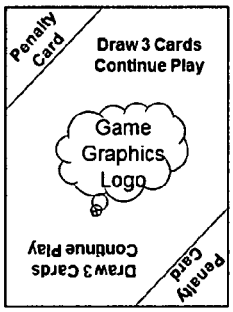
FIG. 3 is a drawing depicting a playing card with graphics on the card face and in the top left corner defining a PENALTY Card that causes a player to be dealt three cards by the Dealer from the Dealer Deck to be added to the player's "Hand." The player may continue play with the cards in his/her "Hand." There are 10 cards with this depiction.
Figure 4:
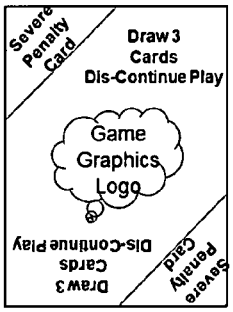
FIG. 4 is a drawing depicting a playing card with graphics on the card face and in the top left corner defining a SEVERE PENALTY Card that causes a player to be dealt three cards by the Dealer from the Dealer Deck to be added to the player's "Hand." The player may not continue play with the cards in his/her "Hand" until play returns to the player. There are 10 cards with this depiction.
Figure 5:
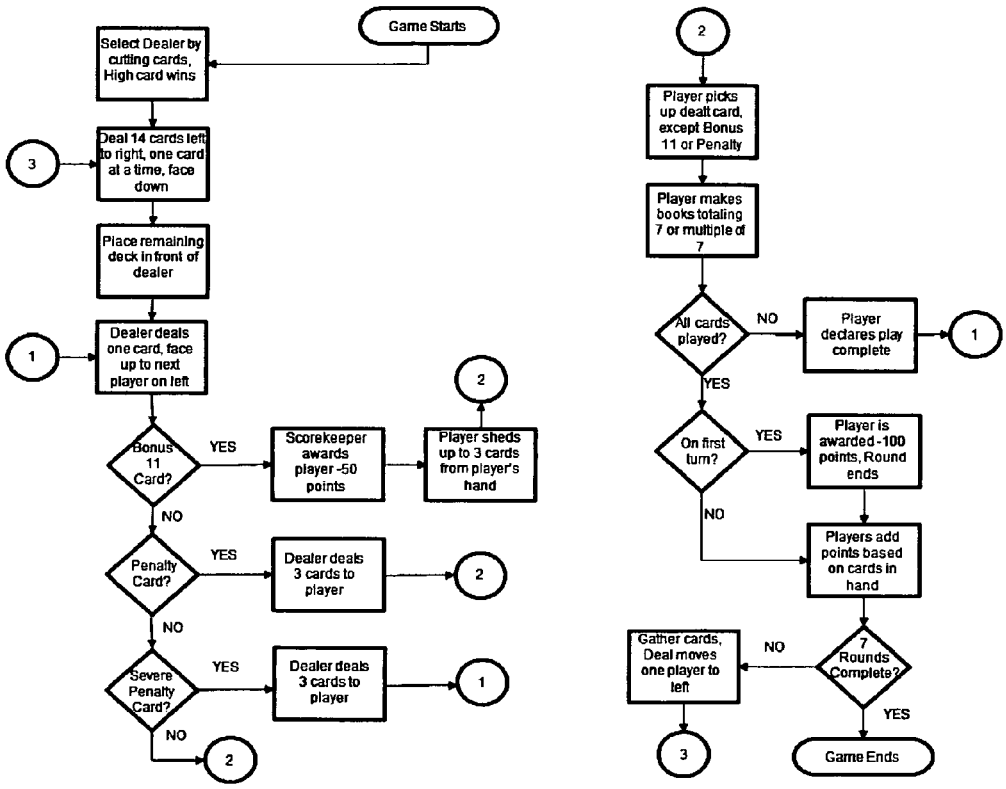

Section 2—Process Flow, FIG. 5 is a visual representation of a previous section titled—Playing Cards in Player's Hand and Making Books. FIG. 5 illustrates the process flow of the game and the decision process needed to play this game.

What is claimed is:

1. A card game apparatus for two to seven players, comprising:

a deck consisting of 150 unsuited playing cards, wherein the deck consisting of 6 unsuited groups of 20 cards each displaying numbers 1, 2, 3, 4, 5, 6, and ten BONUS cards each with a number value of 11, and ten 3'n PLAY penalty cards each with no number value, and ten 3'n SKIP penalty cards each with no number value;

a card dealer for dealing said playing cards;

an initial card hand consisting of 7 or 14 cards is randomly distributed to each of the players;

after the initial cards are dealt, one card is dealt to the player immediately left of the dealer and placed face up on the playing surface in front of the player who attempts to shed all cards from their hand;

if the face up card is an 11 BONUS card, the player's score is immediately reduced by negative 50 points and the player has the option to shed one card from their hand and the face up 11 BONUS card is discarded and the player continues play;

if the face up card is a 3'n PLAY penalty card, the dealer deals 3 cards face down to the player and that player adds the 3 cards to their hand creating a 10 or 17 card hand and the 3'n PLAY penalty card is discarded and that player continues play;

if the face up card is a 3'n SKIP penalty card, the dealer deals 3 cards face down to the player and that player adds the 3 cards to their hand creating a 10 or 17 card hand and the 3'n SKIP penalty card is discarded and that player skips their turn to play.

2. The card game apparatus of claim 1 wherein the face up card being a numbered card, that card shall be added to the player's hand creating an 8 or 15 card hand for that player.

3. The card game apparatus of claim 1 wherein negative scoring possibilities exists.

4. The card game apparatus of claim 3 wherein negative 100 points are awarded to a player who sheds all cards from their hand on first play turn in a round.

5. The card game apparatus of claim 3 wherein negative 50 points are awarded to a player who sheds from their hand a book of 4 or more cards having number values adding to a sum total of 63 or more wherein no 2 cards in that book add to 7.

6. The card game apparatus of claim 1 wherein cards may be shed from a player's hand and placed for discarding on a playing surface or giving to another player or players.

7. The card game apparatus of claim 6 wherein a book of 2 cards adding to a value of 7 may be shed from a player's hand and placed on a playing surface and discarded.

8. The card game apparatus of claim 6 wherein a book of 4 or more cards adding to a sum total of 7 or a multiple of 7 may be shed from a player's hand and placed on a playing surface and discarded.

9. The card game apparatus of claim 6 wherein a book of 4 or more cards may not include any 2 cards that add to the number 7.

10. The card game apparatus of claim 6 wherein there is no limit on number of playing cards in a book of 4 or more cards.

11. The card game apparatus of claim 6 wherein any and all 3'n PLAY and 3'n SKIP penalty cards may be shed from a player's hand by giving to any other player or players.

12. The card game apparatus of claim 6 wherein the 11 BONUS card dealt face up to a player by the dealer gives that player the option to shed 1 card to the playing surface to be discarded.

13. The card game apparatus of claim 6 wherein cards shed from a player's hand to the playing surface for discard shall not be used by any other player.

14. The card game apparatus of claim 1 wherein the game consists of 7 rounds.

15. The card game apparatus of claim 14 wherein the game is ended when 7 rounds of play are completed wherein the player with the lowest score totaling a positive or negative score wins the game.

16. The card game apparatus of claim 1 wherein no cards in the deck of 150 playing cards are wild playing cards.

* * * * *